US006258057B1

(12) United States Patent
Marinello et al.

(10) Patent No.: US 6,258,057 B1
(45) Date of Patent: Jul. 10, 2001

(54) DISPOSABLE MOUTHWASH PACKET

(76) Inventors: Norma Marinello; David A. Horswell, both of 211 Harrison Ave., Mount Holly, NJ (US) 08060

( * ) Notice: Subject to any disclaimer, the term of this patent is extended or adjusted under 35 U.S.C. 154(b) by 0 days.

(21) Appl. No.: 09/271,354

(22) Filed: Mar. 17, 1999

(51) Int. Cl.[7] ..... A61J 7/00
(52) U.S. Cl. ..... 604/77; 220/266
(58) Field of Search ..... 220/266; 215/5, 215/6, 10, 227; 604/77

(56) References Cited

U.S. PATENT DOCUMENTS 4,235,343 * 11/1980 Thompson ..... 215/6

* cited by examiner

*Primary Examiner*—Anhtuan T. Nguyen
*Assistant Examiner*—Michael M Thompson
(74) *Attorney, Agent, or Firm*—Henderson & Sturm LLP

(57) ABSTRACT

A disposable mouthwash packet 10 for use in certain social situations wherein the packet 10 includes an elongated receptacle member 20 provided with a partition which divides the interior of the receptacle member 20 into a mouthwash supply chamber 22 and a used mouthwash recovery chamber 23 wherein each chamber 22, 23 is provided with a closure unit 12 and 13 respectively for withdrawing fresh mouthwash 50 from the supply chamber 22 and introducing used mouthwash into the recovery chamber 23; and wherein, in one version of the invention, the receptacle member 20 has flexible walls and in the other version, the receptacle member 20' has rigid walls.

10 Claims, 1 Drawing Sheet

DISPOSABLE MOUTHWASH PACKET

BACKGROUND OF THE INVENTION

1. Field of the Invention

The present invention relates to the field of self-contained supply receptacles in general and in particular to a disposable mouthwash packet having a collection chamber for the used mouthwash.

2. Description of Related Art

As can be seen by reference to the following U.S. Pat. Nos. 5,002,189; 3,514,029; 4,312,889; and 5,392,947, the prior art is replete with myriad and diverse receptacles containing a pre-loaded supply of a consumable item such as soap, mouthwash, etc.

While all of the aforementioned prior art constructions are more than adequate for the basic purpose and function for which they have been specifically designed, they are uniformly deficient with respect to their failure to provide a simple, efficient, and practical dual compartment arrangement for receptacles; wherein, one of the compartments contains a fresh supply of a consumable liquid such as mouthwash and the other compartment is designed to contain both the used mouthwash as well as a quantity of saliva and food particles that may be produced by the swirling action of the mouthwash in the user's mouth.

As most people are aware, there are many instances when a person may feel compelled to employ mouthwash, but is hesitant to do so due to the fact that there is no convenient place to dispose of the used mouthwash in an unobtrusive and/or polite or otherwise socially acceptable fashion.

As a consequence of the foregoing situation, there has existed a longstanding need for a new and improved type of disposable mouthwash packet which allows a person to gain access to a supply of mouthwash, use the mouthwash for its intended manner, and then dispose the used mouthwash in a very discrete, socially acceptable manner; and, the provision of such a construction is the stated objective of the present invention.

BRIEF SUMMARY OF THE INVENTION

Briefly stated, the disposable mouthwash packet that forms the basis of the present invention comprises, in general, a dual chamber receptacle unit and a pair of closure units wherein each closure unit is operatively associated with one of the dual chambers in the receptacle unit.

As will be explained in greater detail further on in the specification, in one version of the invention, the dual chamber receptacle unit includes a flexible, walled receptacle member; wherein, each chamber is provided with a closure unit comprising a rupturable, self-sealing membrane member.

In addition, in another version of the invention, the dual chamber receptacle unit includes a rigid walled receptacle member; wherein, a mouthwash supply chamber is provided with a closure unit having a frangible, hollow stem portion that serves as a sipping straw for removing fresh mouthwash from the supply chamber.

Furthermore, the other chamber constitutes a used mouthwash recovery chamber having a closure unit that includes a one-way valve member for receiving used mouthwash into the recovery chamber; wherein, in both versions, the volume of the recovery chamber is greater than the volume of the supply chamber.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
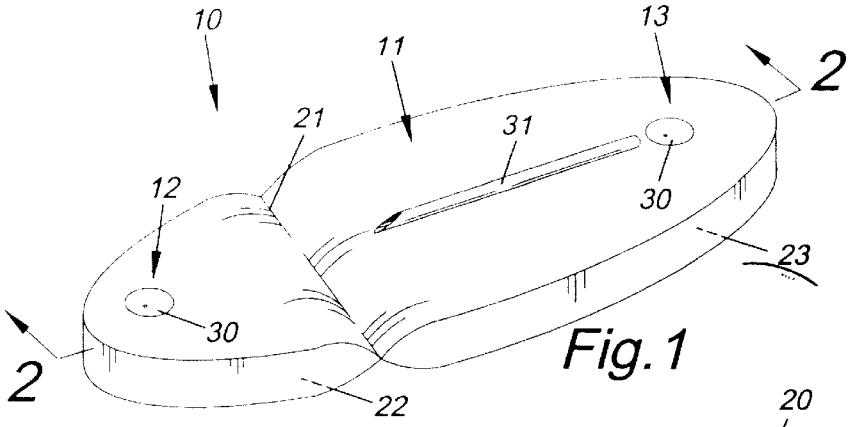
FIG. 1 is a perspective view of the flexible walled version of the disposable mouthwash packet of this invention.

As can be seen by reference to the drawings, and in particular to FIG. 1, the disposable mouthwash packet that forms the basis of the present invention is designated generally by the reference number 11. The packet 10 comprises, in general, a dual chambered receptacle unit 11 wherein each chamber is provided with an independent closure unit 12 and 13. These units will now be described in seriatim fashion.

Figure 2:
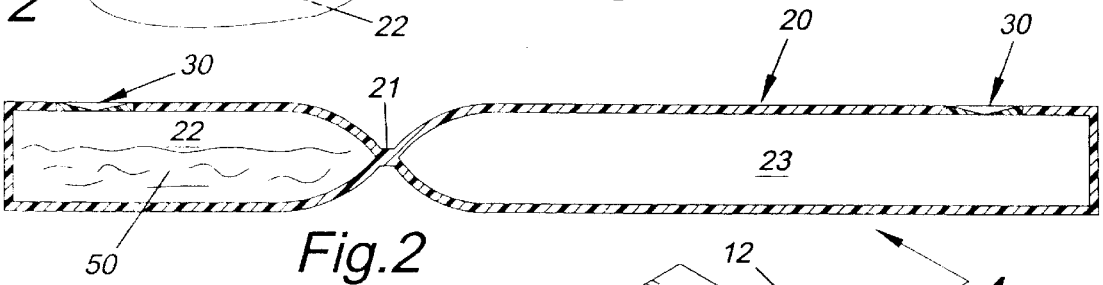
FIG. 2 is a cross-sectional view taken through line 2—2 of FIG. 1.

As shown in FIGS. 1 and 2, one version of the packet 10 involves a dual chamber receptacle unit 11 comprising an elongated, flexible, walled receptacle member 20 divided by a partition 21 into two separate supply and recovery chambers 22 and 23 respectively; wherein, one of the chambers 22 is substantially smaller than the other chamber 23 for reasons that will be explained presently.

In addition, as can best be seen by reference to FIG. 2, the partition 21 is formed by joining the opposed flexible wall surfaces together such as by heat sealing or the like to isolate the larger recovery chamber 23 from the smaller supply chamber 22 in a fluid tight fashion.

Still referring to FIG. 2, it can be seen that in its original state, the smaller supply chamber 22 is dimensioned to receive a quantity of mouthwash 50 and the larger recovery chamber 23 is initially designed to be empty.

In the flexible walled version of the packet 10, depicted in FIG. 1, it can be seen that both of the closure units 12 and 13 are identical and comprise rupturable, selfsealing membrane members 30 which are designed to be punctured by a puncturing element 31 such as a straw that is releasably affixed to the exterior surface of the receptacle member 20 in a well recognized fashion.

In this version, the puncturing element 31 would be used to withdraw the mouthwash 50 from the smaller chamber 22 so that the mouthwash can be rinsed inside of the user's mouth in the normal fashion. This rinsing action, as previously mentioned, will generate saliva within the user's mouth as well as dislodge food particles from the user's teeth which will increase the original volume of the liquid mouthwash removed from the small chamber 22.

At this juncture, the user would employ the puncturing element to penetrate the other membrane member 30 to gain access to the larger recovery chamber 23 such that the user can expel the increased volume used mouthwash, saliva, etc. into the recovery chamber in an unobtrusive socially acceptable fashion; whereby the removal of the puncturing element 31 will allow the recovery chamber membrane 30 to reseal itself so that the user can dispose of the packet 10 at a later time.

Figure 3:
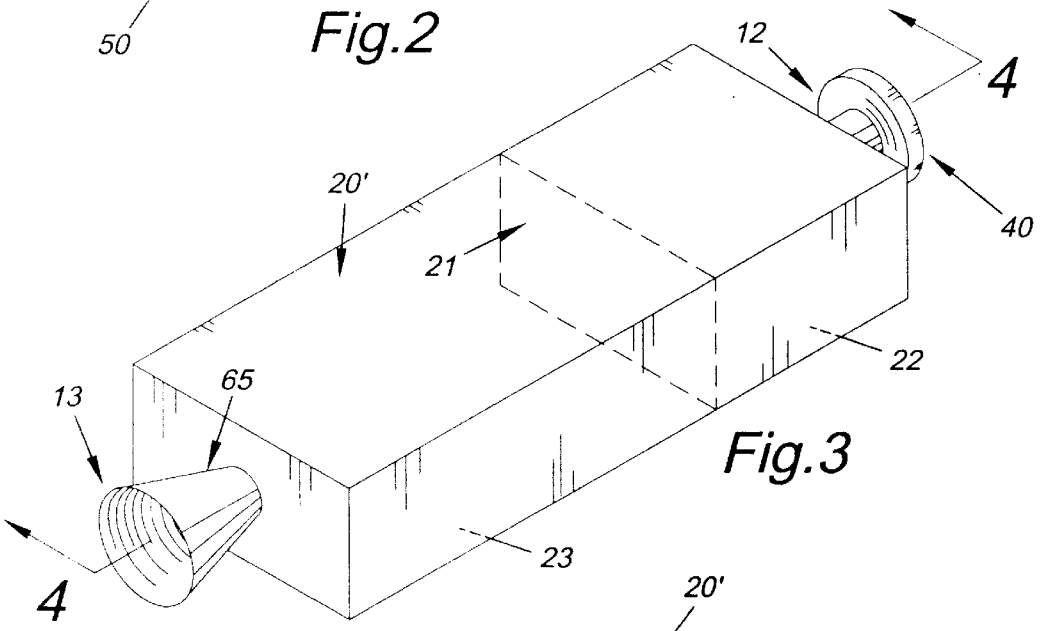
FIG. 3 is a perspective view of the rigid walled version of the disposable mouthwash packet; and, FIG. 4 is a cross-sectional view taken through line 4—4 of FIG. 3.
Figure 4:
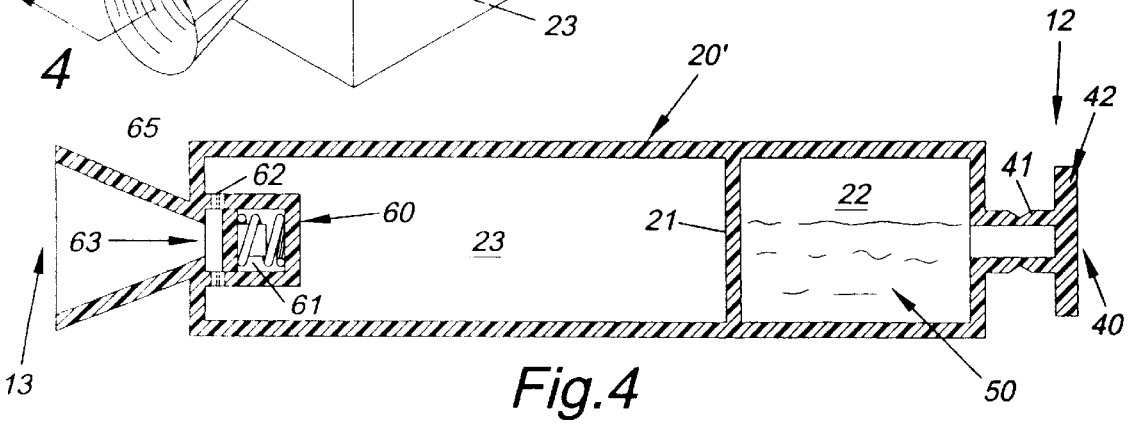

Turning now to FIGS. 3 and 4, it can be seen that the other version of the packet 10 involves a dual chamber receptacle unit 11 comprising a rigid walled receptacle member 20' which is also divided by a partition 21 into a smaller supply chamber 22 and a larger recovery chamber 23.

In addition to the difference in flexibility between the two different types of receptacle members 20, 20', the rigid wall version of FIGS. 3 and 4 also incorporates two closure units 12 and 13 whose purpose and function are quite different from one another as will be explained presently.

As can best be appreciated by reference to FIG. 4, closure unit 12 communicates with the smaller supply chamber 22 and comprises a closure member 40 having a frangible, hollow stem portion 41 provided with an enlarged cap element 42; wherein, the twisting or bending of the cap element 42 will detach the cap element 42 from the step portion 41 to create a drinking straw that will allow the user to extract the mouthwash from the supply chamber 22.

Still referring to FIG. 4, it can be seen that closure unit 13 communicates with the larger recovery chamber 23 and comprises a spring loaded, one-way valve member 61 mounted within a valve housing 60 having ports 63 formed on the in-board end of a funnel-shaped mouthpiece element 65; wherein, the user would expel the increased fluid volume used mouthwash into the mouthpiece element 65 to force the used mouthwash past the valve member 61 where it will become trapped in the recovery chamber 23 for disposal at a later time.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. A disposable mouthwash packet comprising a dual chamber receptacle unit including an elongated receptacle member provided with a partition that divides the receptacle member into a supply chamber and a recovery chamber wherein the chambers are designed to sequentially receive a volume of mouthwash; and, a pair of closure units wherein one of the closure units is associated with the supply chamber for removing a volume of mouthwash from the supply chamber and the other of the closure units is associated with the recovery chamber for receiving a volume of used mouthwash wherein, the pair of closure units are the same and each closure unit comprises: a rupturable, self-sealing membrane member associated with one of the chambers.

2. The packet, as in claim 1; wherein, the pair of closure units are the same and each closure unit comprise a rupturable, self-sealing membrane member associated with one of the chambers.

3. The packet, as in claim 2, further comprising a straw element releasably associated with the receptacle member for withdrawing mouthwash from the supply chamber and depositing used mouthwash into the recovery chamber.

4. The packet as in claim 1; wherein, the receptacle member has rigid walls.

5. The packet as in claim 4; wherein, said one of the closure units includes a closure member having a frangible hollow stem portion provided with an enlarged cap element.

6. The packet as in claim 5; wherein, said other of the closure units includes a one-way valve member.

7. The packet as in claim 6; wherein, the one-way valve member is provided with a funnel-shaped mouthpiece for receiving used mouthwash under pressure to unseal the one-way valve member.

8. a disposable mouthwash packet comprising a dual chamber receptacle unit ncluding an elongated receptacle member having rigid walls and provided with a partition that divides the receptacle member into a supply chamber and a recovery chamber wherein the chambers are designed to sequentially receive a volume of mouthwash; and a pair of closure units wherein one of the closure units is associated with the supply chamber for removing a volume of mouthwash from the supply chamber and the other of the closure units is associated with the recovery chamber for receiving a volume of used mouthwash, wherein, said recovery chamber has a greater volume than said supply chamber; and, wherein, said one of the closure units includes a closure member having a frangible hollow stem portion provided with an enlarged cap element and, said other of the closure units includes a one-way valve member.

9. The packet, as in claim 8, further comprising a straw element releasably associated with the receptacle member for withdrawing mouthwash from the supply chamber and depositing used mouthwash into the recovery chamber.

10. The packet as in claim 8; wherein, the one-way valve member is provided with a funnel shaped mouthpiece for receiving used mouthwash under pressure to unseal the one-way valve member.

* * * * *